US010188891B2

(12) United States Patent
Ho et al.

(10) Patent No.: US 10,188,891 B2
(45) Date of Patent: Jan. 29, 2019

(54) STEPPER MACHINE WITH ELASTIC RESISTANCE GENERATING COMPONENT

(71) Applicants: Wei-Teh Ho, Taipei (TW); Willy Wei Yu Ho, Taipei (TW)

(72) Inventors: Wei-Teh Ho, Taipei (TW); Willy Wei Yu Ho, Taipei (TW)

( * ) Notice: Subject to any disclaimer, the term of this patent is extended or adjusted under 35 U.S.C. 154(b) by 126 days.

(21) Appl. No.: 15/250,768

(22) Filed: Aug. 29, 2016

(65) Prior Publication Data

US 2018/0056105 A1 Mar. 1, 2018

(51) Int. Cl.

| | |
|---|---|
| ***A63B 22/04*** | (2006.01) |
| ***A63B 21/045*** | (2006.01) |
| ***A63B 22/00*** | (2006.01) |
| *A63B 21/00* | (2006.01) |
| *A63B 71/06* | (2006.01) |

(52) U.S. Cl.

CPC ..... *A63B 21/045* (2013.01); *A63B 22/0058* (2013.01); *A63B 21/00069* (2013.01); *A63B 71/0619* (2013.01); *A63B 2220/00* (2013.01); *A63B 2220/17* (2013.01)

(58) Field of Classification Search

CPC ..... A63B 22/0056

See application file for complete search history.

(56) References Cited

U.S. PATENT DOCUMENTS

| | | | | |
|---|---|---|---|---|
| 79,654 A * | 7/1868 | Hanlon | ..... | B62K 21/00 280/270 |
| 5,062,627 A * | 11/1991 | Bingham | ..... | A63B 21/05 482/53 |
| 5,304,106 A * | 4/1994 | Gresko | ..... | A63B 22/0056 482/53 |
| 5,336,146 A * | 8/1994 | Piaget | ..... | A63B 22/0056 482/51 |
| 6,709,366 B2 * | 3/2004 | Chuang | ..... | A63B 22/0056 482/53 |

* cited by examiner

*Primary Examiner* — Loan H Thanh
*Assistant Examiner* — Rae Fischer
(74) *Attorney, Agent, or Firm* — Womble Bond Dickinson (US) LLP

(57) ABSTRACT

Embodiments of an exercise machine are disclosed. In one embodiment, an exercise machine includes a base frame, a pair of left and right pedal assemblies, and a pedal supporting assembly. The base frame is adapted to be positioned on a support surface. The left and right pedal assemblies have a pair of left and right pedals, and each is positioned over and rotatably supported by the base frame. The pedal supporting assembly is attached to the base frame and configured to pivot around an axis. The pedal supporting assembly also supports the left and right pedal assemblies. The pedal supporting assembly is operable to generate resistance in response to movement of the left and right pedals and the pedal supporting assembly pivoting around the axis.

17 Claims, 11 Drawing Sheets

STEPPER MACHINE WITH ELASTIC RESISTANCE GENERATING COMPONENT

FIELD OF THE INVENTION

Embodiments of the present invention relate generally to exercise machines. More particularly, embodiments of the invention relate to exercise machines commonly referred to stepper machines.

BACKGROUND

As people eat better and work longer, mostly sitting in an office, they wish to use exercise machines more frequently, preferably without visiting a fitness center or gymnasium. As a result, the use of stepper machines, whether at home or in office, has become popular.

Stepper machines are usually configured to generate stable and adjustable resistance, so that a user can choose different levels of exercise. Most stepper machines are equipped with a hydraulic cylinder, known as hydraulic steppers. These stepper machines can become overheated when being used for a short period of time because of the frictions of the cylinder, sometimes for just 15 or 20 minutes. The problem of overheating has several implications. The overheated mechanical parts can easily scald or even burn a user's body. The hydraulic fluid can also become degraded, affecting the viscosity grade of the oil and the performance of the stepper machine's resistance generation.

Stepper machines with hydraulic cylinders are also susceptible to other problems as well, such as oil leakage, unequal or unstable resistance generation between left and right pedals, and noises. The maximum speed or frequency a user can step on the stepper machine can also be limited by various mechanical parts of the hydraulic cylinders as well, as the speed of such mechanical movements is constrained.

BRIEF DESCRIPTION OF THE DRAWINGS

Embodiments of the invention are illustrated by way of example and not limitation in the figures of the accompanying drawings in which like references indicate similar elements.

DETAILED DESCRIPTION

Figure 1:
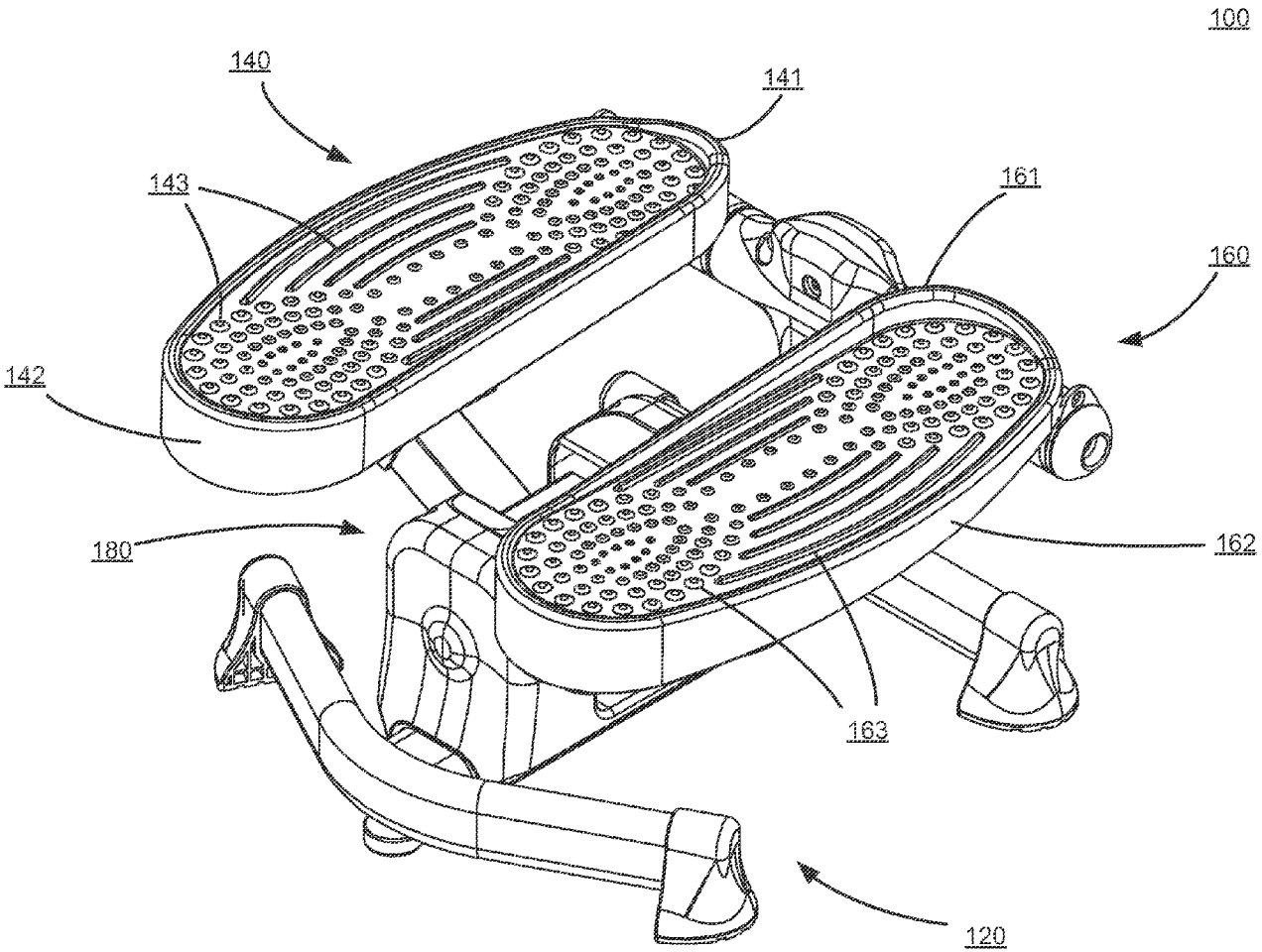
FIG. 1 shows a perspective view of an exercise machine according to one embodiment of the invention.

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Reference in the specification to "one embodiment" or "an embodiment" means that a particular feature, structure, or characteristic described in conjunction with the embodiment can be included in at least one embodiment of the invention. The appearances of the phrase "in one embodiment" in various places in the specification do not necessarily all refer to the same embodiment.

Embodiments of the invention improve the traditional hydraulic cylinder exercise machines by providing a resistance generation mechanism without using a hydraulic cylinder. In one embodiment, such resistance is generated by an elastic component of a pedal supporting assembly supporting a pair of pedals, when the pedal supporting assembly pivots away from a neutral position around an axis. As explained in more details below and/or will be appreciated by a person having ordinary skills in the art, the improved design overcomes various shortcomings of the current stepper machines, such as eliminating the overheating problem, eliminating the oil leakage problem, consistent and stable resistance generation, noise reduction. The maximum speed or frequency a user can step on the stepper machine is also significantly increased by using the elastic component to generate the resistance.

In one embodiment, an exercise machine according to one embodiment of the present disclosure includes a base frame, a pair of left and right pedal assemblies, and a pedal supporting assembly. The base frame is adapted to be positioned on a support surface. The left and right pedal assemblies have a pair of left and right pedals, and each pedal is positioned over and rotatably supported by the base frame. The pedal supporting assembly is attached to the base frame and configured to pivot around an axis. The pedal supporting assembly also supports the left and right pedal assemblies. The pedal supporting assembly is operable to generate resistance in response to movement of the left and right pedals and the pedal supporting assembly pivoting around the axis.

In one embodiment, the resistance generated by the elastic component is proportional to a degree by which the pedal supporting assembly pivots away from a neutral position. The relationship between the resistance and the degree may or may not be directly proportional. In one embodiment, the axis around which the pedal supporting assembly pivots is in a longitudinal direction of the exercise machine and parallel to the support surface.

In one embodiment, the pedal supporting assembly includes an elastic component adapted to attach the pedal supporting assembly to the base frame. The elastic component becomes deformed, when the pedal supporting assembly pivots away from a neutral position, to adapt to a position change and generate the resistance. The base frame includes a bottom body to attach the pedal supporting assembly to the base frame. The bottom body is configured with a front end receptacle and a rear end receptacle both to receive and constrain the elastic component, where both the front end and rear end receptacles of the bottom body are stationary when the left and right pedals are in motion. The pedal supporting assembly includes a pedal supporting component for supporting the left and right pedal assemblies. The pedal supporting component has a hollow cross-section to contain the elastic component.

In one embodiment, an exercise machine according to one embodiment of the present disclosure includes a handlebar assembly attached to the base frame to allow a user to hold onto the handlebar while stepping on the left and right pedals. In one embodiment, the exercise machine includes a display unit to display user exercise information.

FIG. 1 shows a perspective view of an exercise machine according to one embodiment of the invention. The exercise machine 100 includes a base frame 120, a pair of left and right pedal assemblies 140/160, and a pedal supporting assembly 180. The base frame 120 is an H-shape frame that can be positioned on a support surface. The left and right pedal assemblies 140/160 have a pair of left and right pedals 142/162. The pedal supporting assembly 180 is attached to the base frame 120 and configured to pivot around an axis (see numeral 182 of FIG. 2 below). The pedal supporting assembly 180 also supports the left and right pedal assemblies 140/160. The left and right pedals 142/162 have friction increasing features or raised tracks 143/163 and a heightened boundary 141/161 (e.g., a pedal well) to prevent a user's feet from slipping off the pedals.

Figure 2:
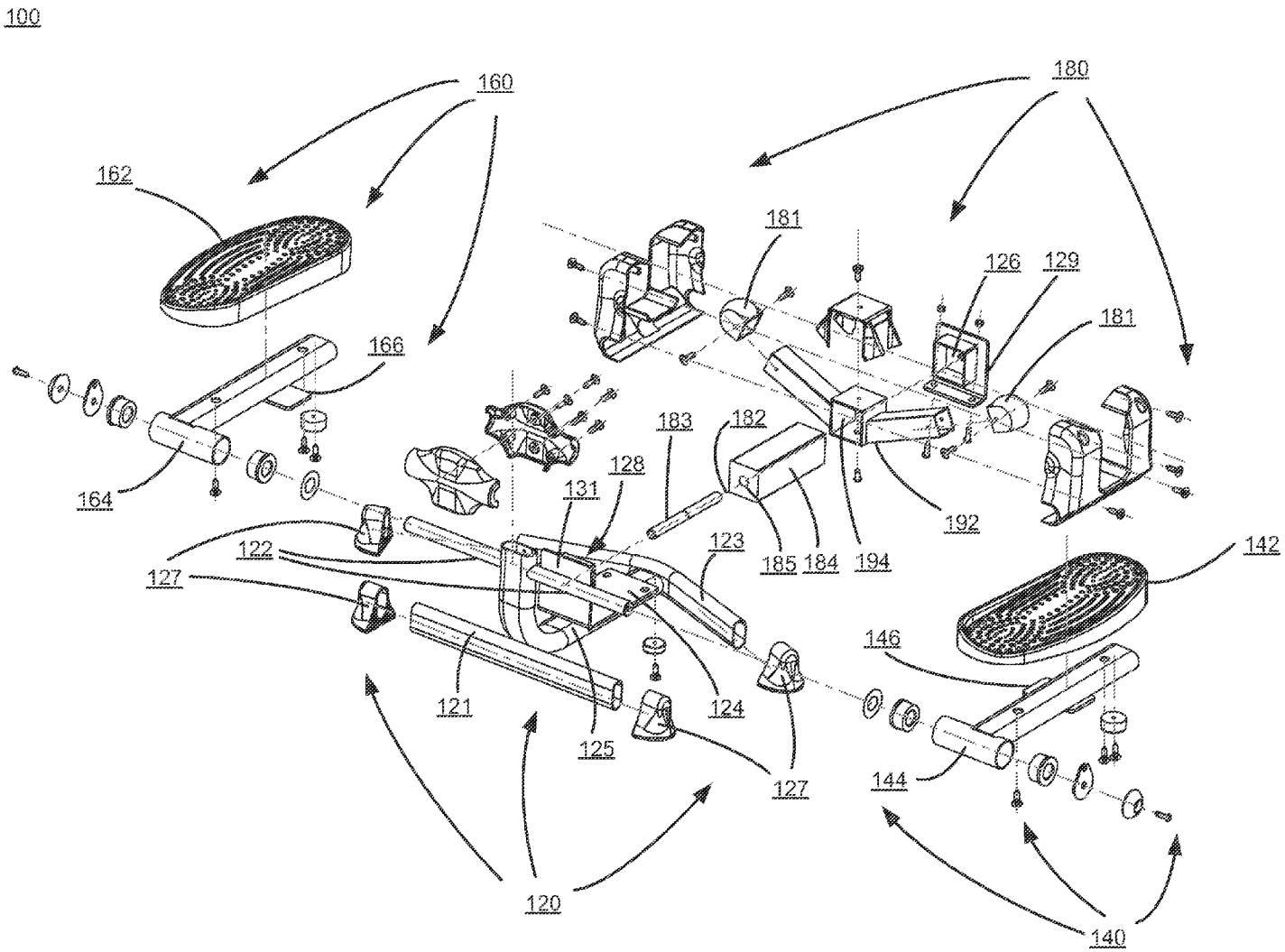
FIG. 2 shows an exploded view of an exercise machine according to one embodiment of the invention.

FIG. 2 shows an exploded view of an exercise machine according to one embodiment of the invention. The base frame 120 includes two lateral bars 121 and 123 connected by a linking beam 125 to support the exercise machine on the support surface. At both edges of each of the lateral bars 121 and 123 is a pad or cap 127 which is placed at the bottom of the exercise machine 100 and directly supported by the support surface to avoid scratching the support surface or reduce slippery from the support surface. A level 122 is configured near the upper portion of the linking beam 125, extending in both lateral directions to rotatably support the left and right pedal assemblies 140/160 at their first end 144/164. The level 122 is parallel to the support surface. The base frame 120 further includes a bottom body or plate 124 for attaching the pedal supporting assembly 180 to the base frame 120. The bottom body or plate 124 is configured with a front end plate 131 and a rear end plate 129, which are L-shape brackets that can be mounted on bottom plate 124 using screws. Both the front end plate 131 and the rear end plate 129 have a receptacle 128 (directly visible in FIGS. 3 and 5) and 126 (directly visible in FIGS. 2 and 5). The receptacles 128 and 126 are configured to receive and constrain an elastic component 184 of the pedal supporting assembly 180. Because the front end plate 131 and the rear end plate 129 are part of the bottom body or plate 124 that is attached (usually fixed) to the base frame 120 (so are the receptacles 128 and 126), they remain stationary when the left and right pedal assemblies 140/160 are in motion.

As described above, both the left and right pedal assemblies 140/160 are rotatably supported by the base frame at each pedal assembly's first end 144/164 that fits the left portion and right portion of the level 122, respectively. Each of the left and right pedal assemblies 140/160 includes a second end 146/166 supported by the pedal supporting assembly 180.

As mentioned above, the pedal supporting assembly 180 is attached to the base frame via the bottom body or plate 124. The pedal supporting assembly 180 includes an axle 183, an elastic component 184, and a pedal supporting component or bar 192. As shown in FIG. 2, the pedal supporting assembly 180 also includes other components for assembling the pedal supporting assembly 180 and for attaching it to the base frame 120. The elastic component 184 is adapted to attach the pedal supporting assembly 180 to the base frame 120 while allowing the pedal supporting assembly 180 to pivot around an axis 182, as explained in more details below. The elastic component 184 may be a plastic component. In one embodiment, the elastic component 184 is made from a special type of engineering plastics, which generates a resilient torsion or resistance when becoming deformed.

The pedal supporting component or bar 192 includes a left section and a right section extended outwardly, each including a cover 181 and supporting the left and right pedal assemblies 140/160, respectively. The pedal supporting component or bar 192 has a hollow cross-section 194 to contain the elastic component 184, which is to be received and constrained by the receptacles 128 and 126 of the front end plate 131 and the rear end plate 129 of the bottom body or plate 124. The elastic component 184 includes a hole 185 through which the axle 183 supports the elastic component 184. The axle 183 is then supported by the front end plate 131 and the rear end plate 129.

Referring to both FIGS. 1 and 2, when a user's feet are placed on the left and right pedal 142/162 to start stepping, the pedal supporting assembly 180 pivots around an axis 182 that overlaps with the axle 183. The axis 182 is in a longitudinal direction of the exercise machine 100 and parallel to the support surface. In the pivoting process, the elastic component 184 is constrained by the receptacles 128 and 126 at both of its edges and thus is restricted from pivoting along with the pedal supporting assembly 180. Thus, when the pedal supporting assembly 180 pivots around the axis 182 and away from a neutral position, making the central portion of the elastic component 184 pivot with it, the elastic component 184 will become deformed, such that both of its edges generate torsion or resistance to force its central portion which pivots with the pedal supporting assembly 180 to return to the neutral position. It will be readily appreciated by a person having ordinary skills in the art that the resistance to the left pedal is substantially the same with the resistance to the right pedal with this new design. In one embodiment, the resistance generated by the elastic component 184 is proportional to a degree by which the pedal supporting assembly 180 pivots away from the neutral position (e.g., up and down movement of the pedals). The relationship between the resistance and the degree may or may not be directly proportional. In addition, by using the elastic component to generate the resistance, which provides for prompt returning to the neutral position after pivoting, the maximum speed or frequency a user can step on the stepper machine is also significantly increased.

Figure 3:
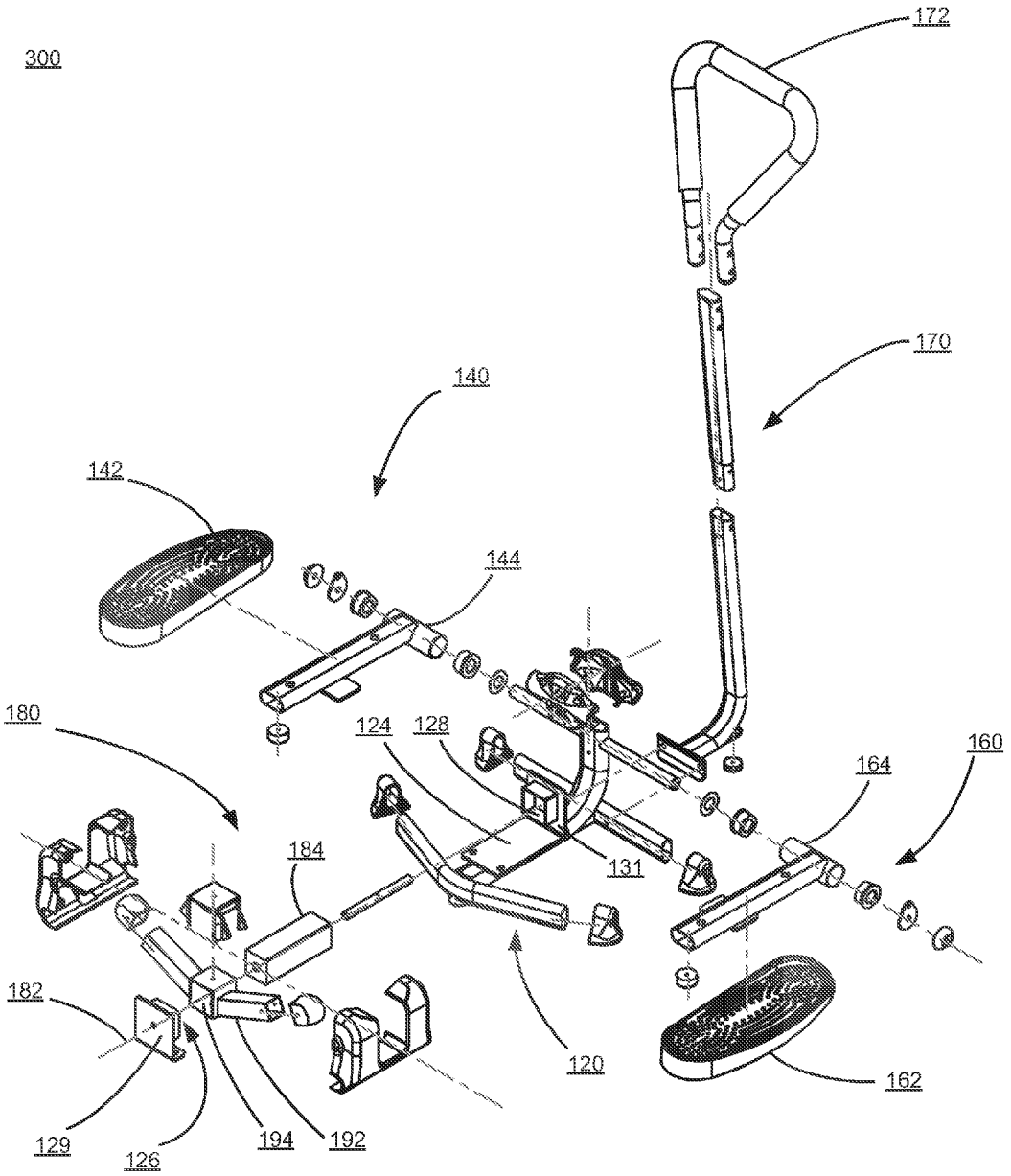
FIG. 3 shows an exploded view of an exercise machine according to another embodiment of the invention.
Figure 6:
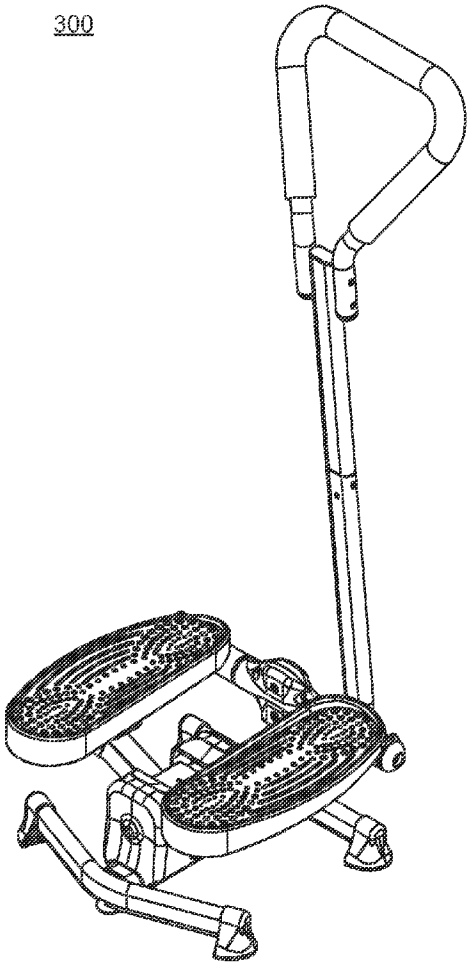
FIG. 6 shows a perspective view of an exercise machine according to another embodiment of the invention.

FIG. 3 shows an exploded view of an exercise machine 300 according to another embodiment of the invention. FIG. 6 shows a perspective view of such an exercise machine. It is pointed out that those elements of FIGS. 3 and 6 having the same reference numbers (or names) as the elements of any other figure can operate or function in any manner similar to that described, but are not limited to such. The following embodiments are explained with reference to FIGS. 3 and 6.

The difference of FIGS. 3 and 6 with FIGS. 1 and 2 is that the exercise machine 300 of FIGS. 3 and 6 includes a handlebar assembly 170 with a handlebar 172. The handlebar assembly 170 is attached to a front end of the base frame 120, allowing a user to hold onto the handlebar 172 while stepping on the left and right pedals 142/162. As mentioned above, the receptacle 128 of the front end plate 131 is better illustrated in FIG. 3, which receives and constrains the elastic component 184.

Figure 4:
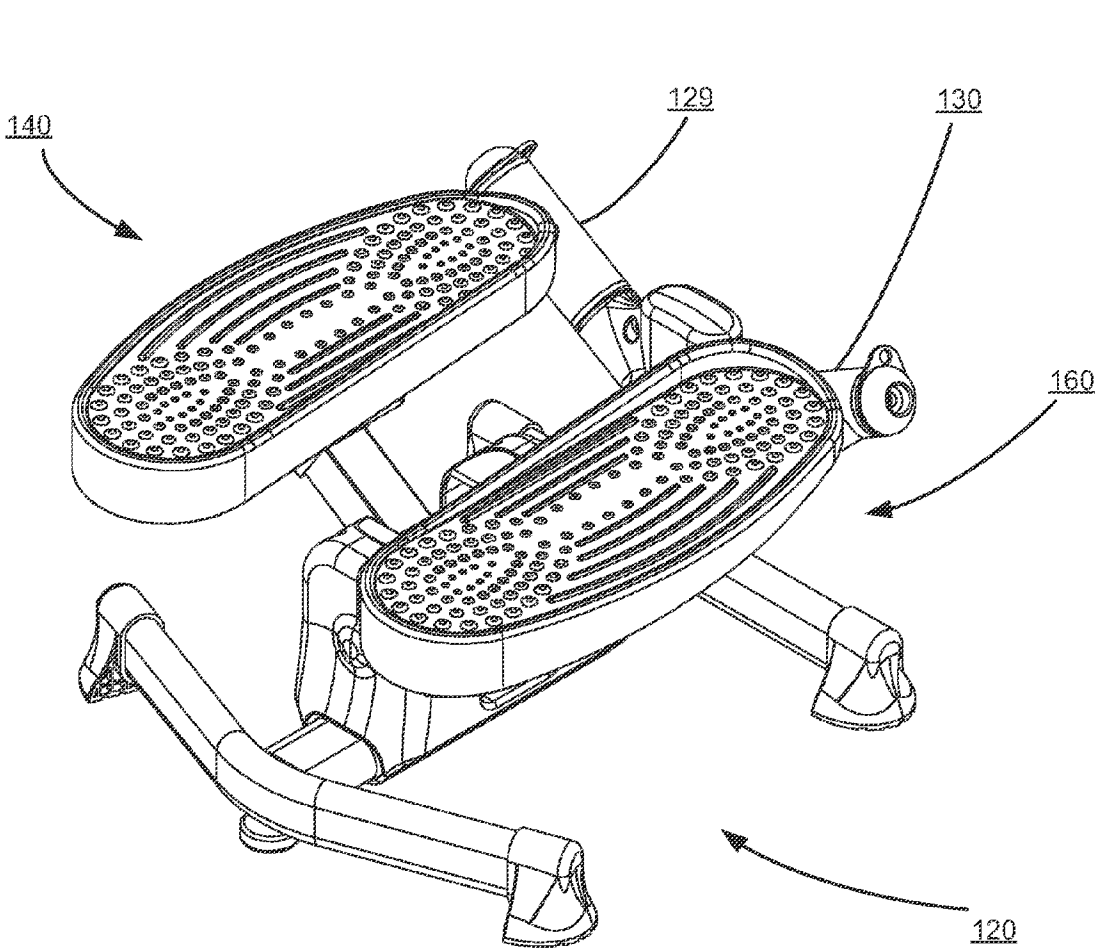
FIG. 4 shows a perspective view of an exercise machine according to another embodiment of the invention.

FIG. 4 shows a perspective view of an exercise machine 400 according to another embodiment of the invention. It is pointed out that those elements of FIG. 4 having the same reference numbers (or names) as the elements of any other figure can operate or function in any manner similar to that described, but are not limited to such. The following embodiments are explained with reference to FIG. 4.

In FIG. 4, an exercise machine 400 known as "lateral thigh trainer" is shown. The difference of the exercise machine 400 with the exercise machine 100 of FIGS. 1 and 2 is that the base frame 120 of the exercise machine 100 includes a level 122 supporting the left and right pedal assemblies 140/160 that is parallel to the support surface, while the exercise machine 400 includes a left supporting rod 129 to support the left pedal assembly 140 and a right supporting rod 130 to support the right pedal assembly 160, and that the left and right supporting rods 129/130 form an angle of less than 180 degrees (e.g., a V-shape component) and are not parallel to the support surface. As a result, one of the pedals moves downwardly and outwardly while the other pedal moves upwardly and inwardly.

Figure 5:
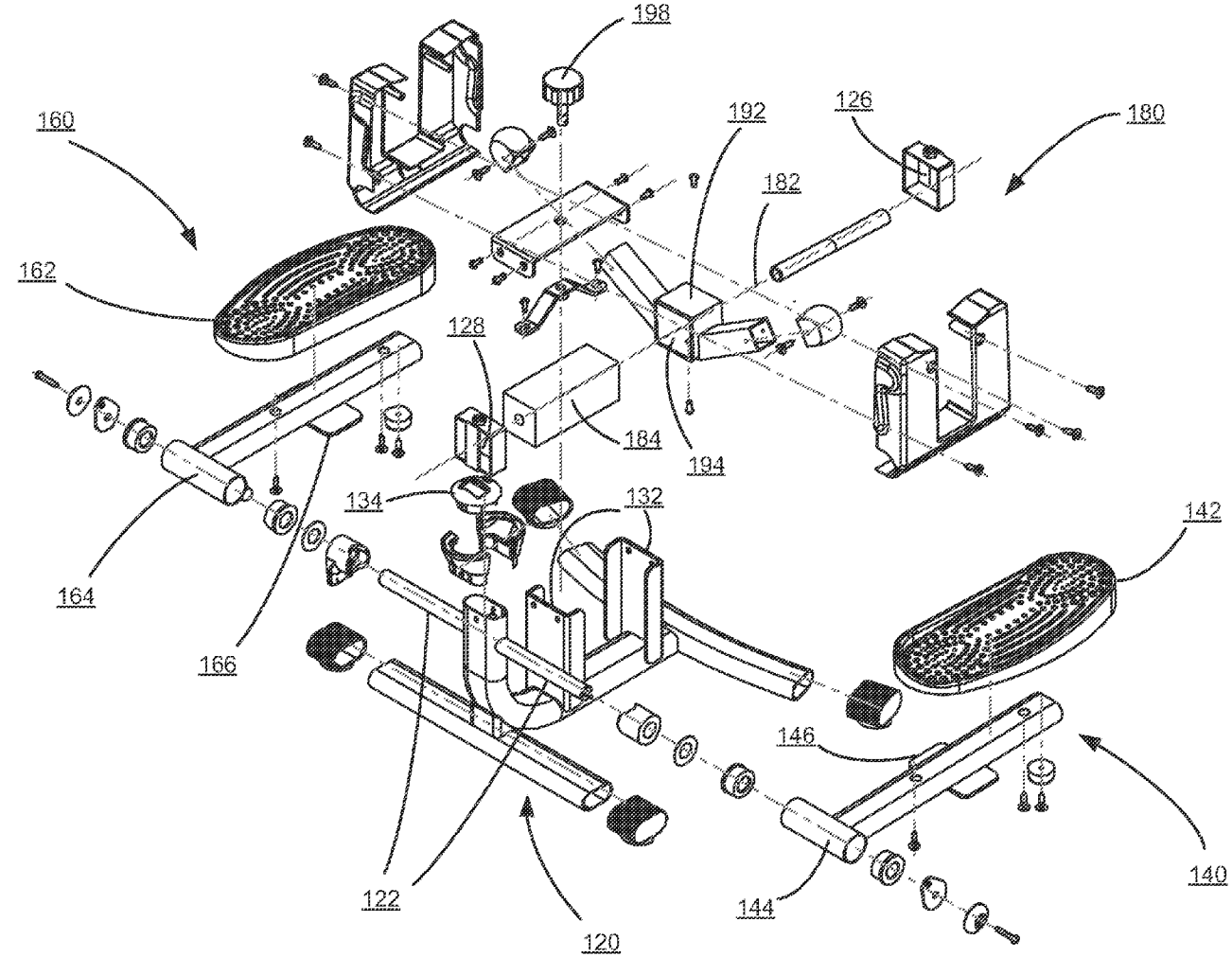
FIG. 5 shows an exploded view of an exercise machine according to another embodiment of the invention.

FIG. 5 shows an exploded view of an exercise machine according to another embodiment of the invention. It is pointed out that those elements of FIG. 5 having the same reference numbers (or names) as the elements of any other figure can operate or function in any manner similar to that described, but are not limited to such. The following embodiments are explained with reference to FIG. 5.

In FIG. 5, the bottom body includes a pair of sliding slots 132 to hold the front end and rear end receptacles 128 and 126, the pedal supporting component 192, and the elastic component 184. The sliding slots 132 are attached to the base frame 120. In one embodiment, the relative position of the front end and rear end receptacles 128 and 126, the pedal supporting component 192, and the elastic component 184 with respect to the pair of sliding slots 132 is adjustable and proportional to the resistance generated by the pedal supporting assembly 180. In one embodiment, the relative position can be adjusted by fastening or loosening a knob 198. In one embodiment, the lower the relative position, the stronger the resistance generated by the elastic component 184. In another embodiment, the relationship between the relative position and the strongness of the resistance generated by the elastic component 184 is reversed.

Figure 7:
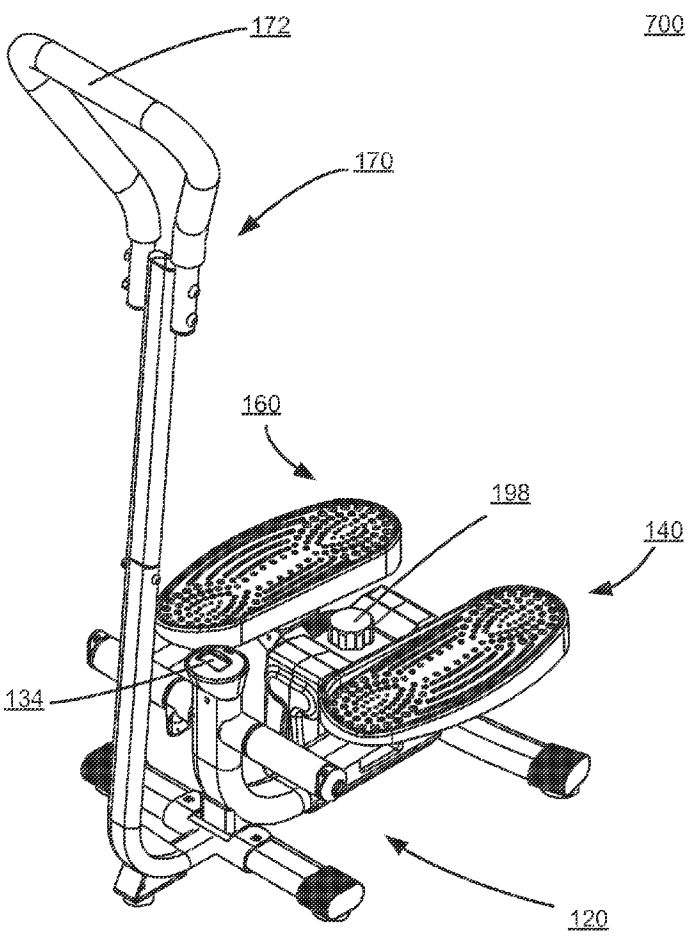
FIG. 7 shows a perspective view of an exercise machine according to another embodiment of the invention.

FIG. 7 shows a perspective view of an exercise machine according to another embodiment of the invention. It is pointed out that those elements of FIG. 7 having the same reference numbers (or names) as the elements of any other figure can operate or function in any manner similar to that described, but are not limited to such. The following embodiments are explained with reference to FIG. 7.

The difference of FIG. 7 with FIG. 5 is that the exercise machine 700 of FIG. 7 includes a handlebar assembly 170 with a handlebar 172. The handlebar assembly 170 is attached to a front end of the base frame 120, allowing a user to hold onto the handlebar 172 while stepping on the left and right pedals. Also note that both the exercise machine 500 of FIG. 5 and the exercise machine 700 of FIG. 7 include a display unit 134 to display user exercise information. The user exercise information can be obtained by sensors that take in various movement and/or usage information and record or calculate the exercise information to be displayed. For example, such information may include the time spent on an exercise session, the calorie consumed, the number of pivoting by the pedals, etc.

Figure 8B:
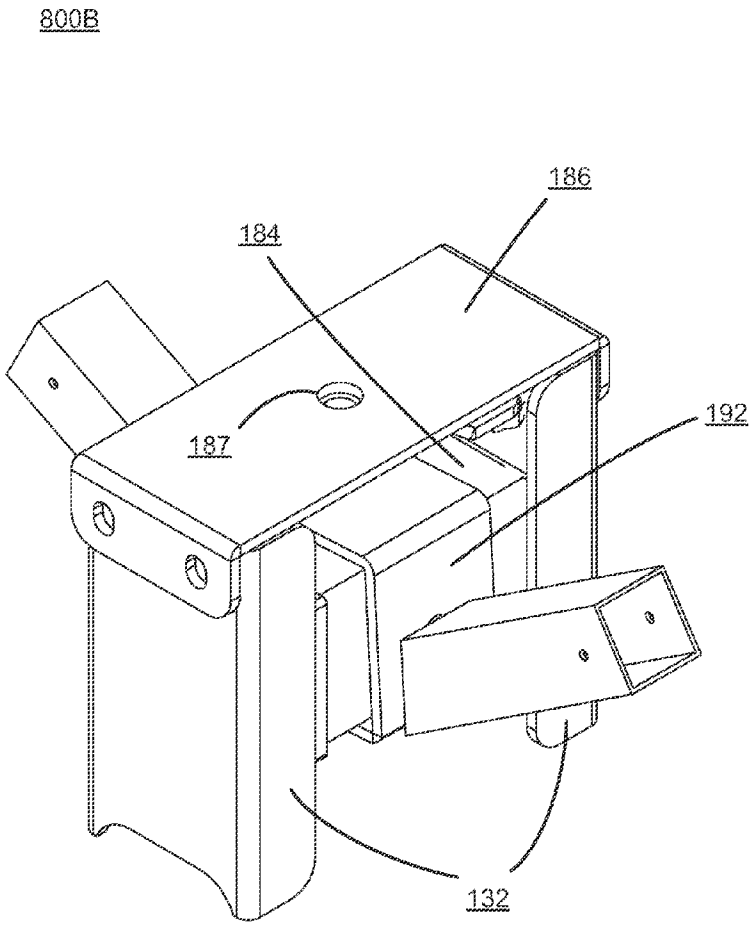
FIGS. 8A and 8B show a perspective view of part of a pedal supporting assembly according to two embodiments of the invention, respectively.
Figure 8A:
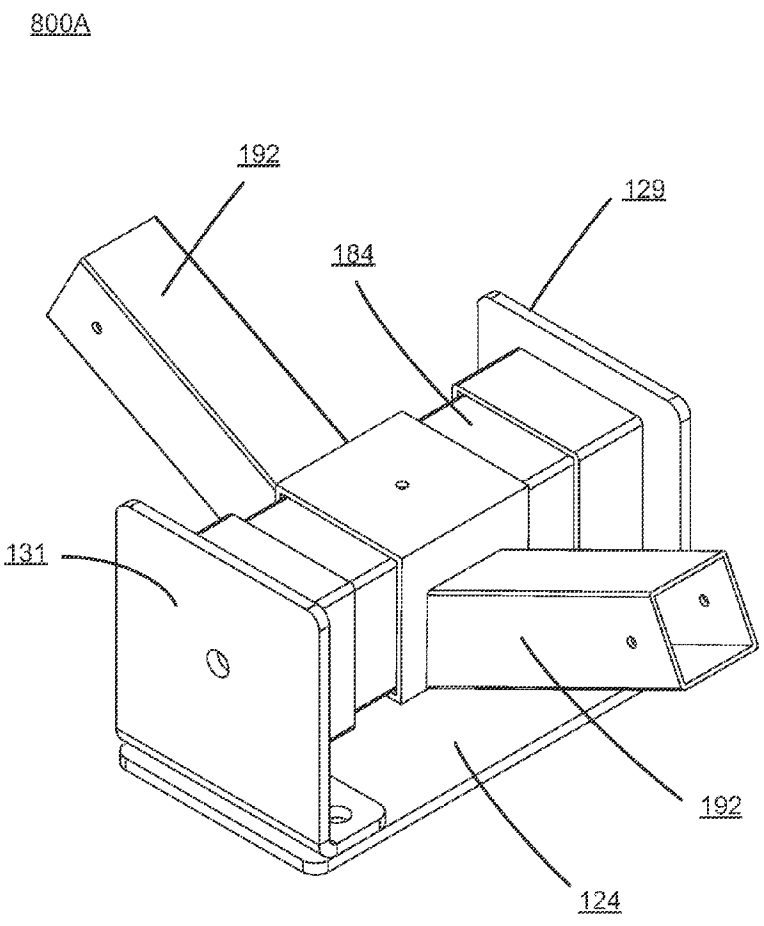

FIGS. 8A and 8B show a perspective view of part of a pedal supporting assembly according to two embodiments of the invention, respectively. It is pointed out that those elements of FIGS. 8A and 8B having the same reference numbers (or names) as the elements of any other figure can operate or function in any manner similar to that described, but are not limited to such. The following embodiments are explained with reference to FIGS. 8A and 8B.

The part 800A shows part of a pedal supporting assembly according to an embodiment of the invention, including a bottom body or plate 124 with a front end plate 131 and a rear end plate 129, a pedal supporting component 192, and an elastic component 184. In this embodiment, L-shape plates 129 and 131 are mounted on the bottom plate 124 via a pair of screws. The elastic component 184 is retained by plates 129 and 131. Specifically, both ends of the elastic component 184 are held steadily by the receptacles of plates 129 and 131, while the central portion of the elastic component 184 may be twisted by the movement of the bars 192, which in turn generates resistance against the movement of the bars 192.

The part 800B shows part of a pedal supporting assembly according to another embodiment of the invention, including a pair of sliding slots 132 to hold the front end and rear end receptacles 128 and 126 (not shown), a pedal supporting component 192, and an elastic component 184. In this embodiment, the sliding slots 132 are configured as a U-shape bracket, whose lower ends are perpendicularly mounted on a center beam of the H-shape base frame. The upper ends of the brackets 132 are coupled to a cover plate 186. In this example, the cover plate 186 is formed as a U-shape plate downwardly. The cover plate 186 further includes a threaded hole 187 to allow the knob 198 with a threaded screw to move upwardly and downwardly. The knob 198, when rotating, will push or release the entire support assembly 192 downwardly and upwardly within the sliding slots 132.

Figure 9B:
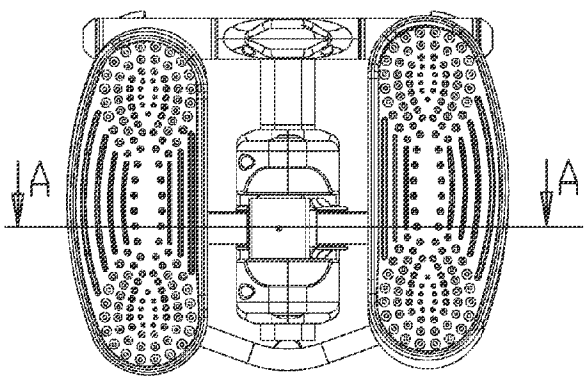
FIGS. 9A and 9B show two sectional views of an exercise machine according to one embodiment of the invention.
Figure 9B:
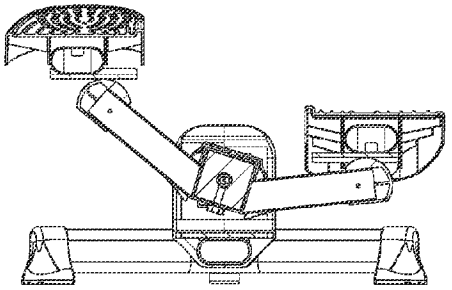
Figure 9A:
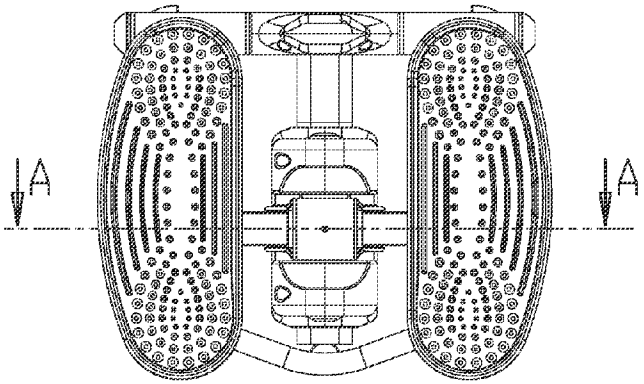
Figure 9A:
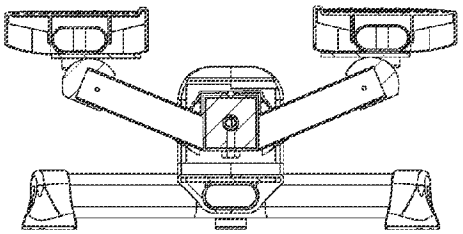
Figure 9D:
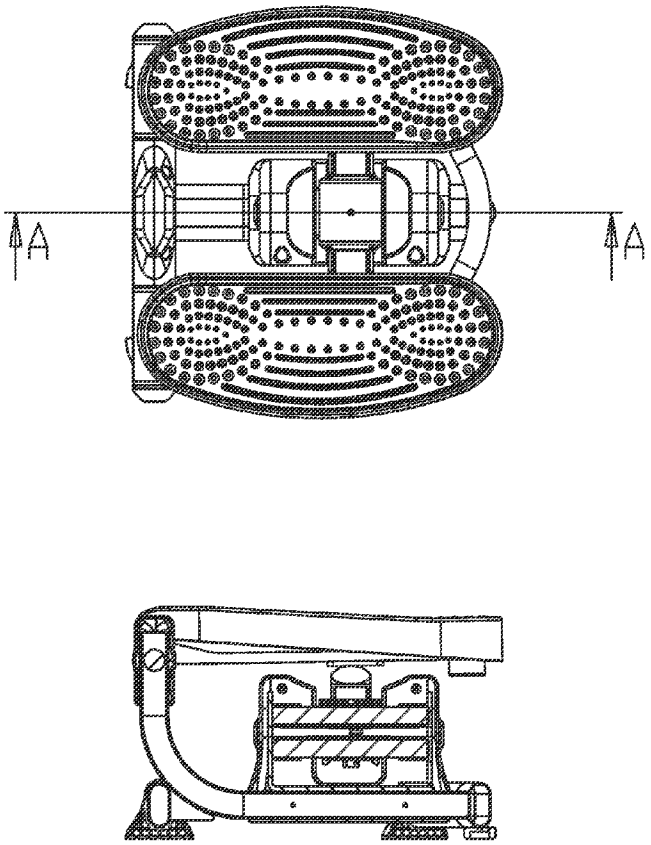
FIGS. 9C and 9D show two left side sectional views of the exercise machine.
Figure 9C:
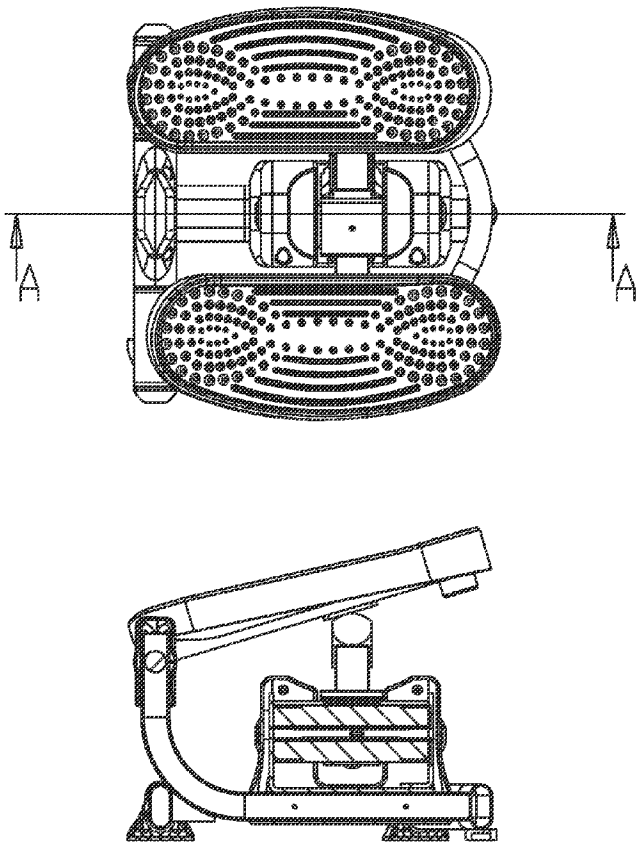

FIGS. 9A and 9B show two sectional views of an exercise machine according to one embodiment of the invention. FIGS. 9C and 9D show two left side sectional views of the exercise machine. The exercise machine in FIGS. 9A-9D corresponds to the perspective view of FIG. 1 and the exploded view of FIG. 2.

Figure 10B:
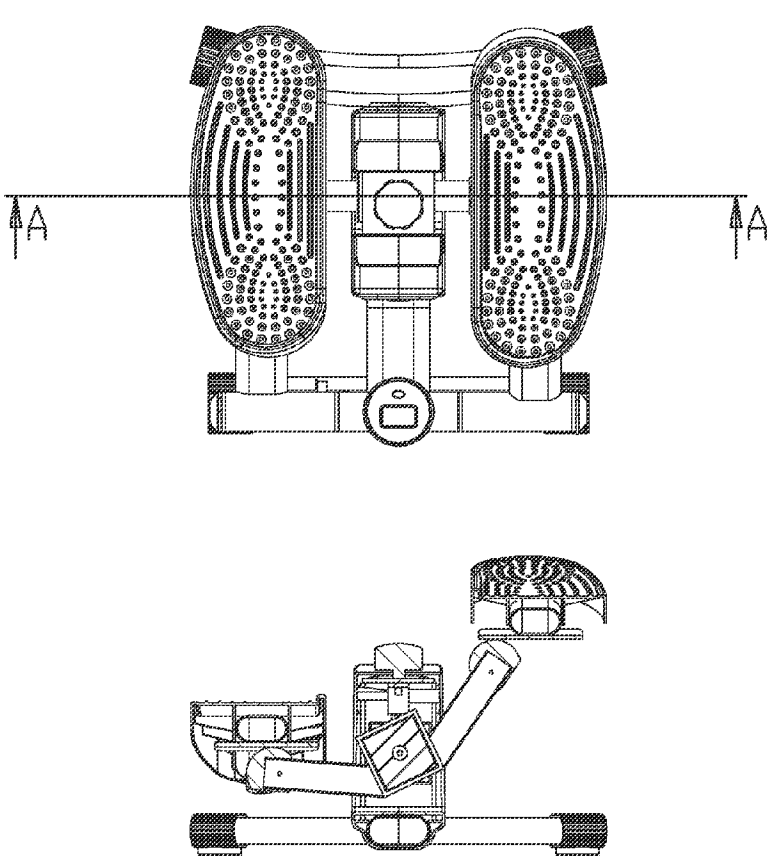
FIGS. 10A and 10B show two sectional views of an exercise machine according to another embodiment of the invention.
Figure 10A:
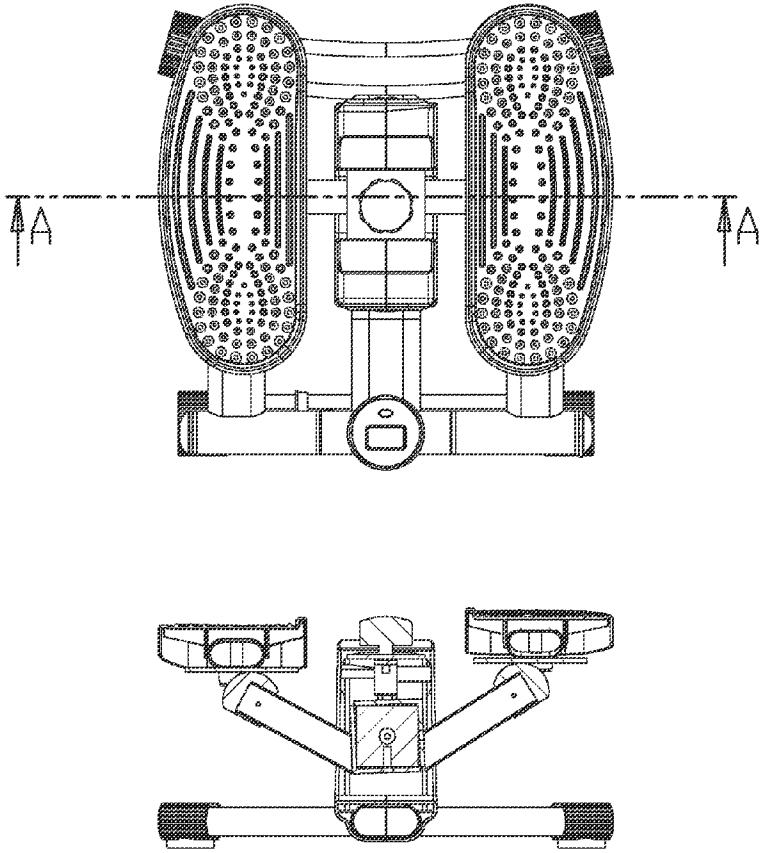
Figure 10D:
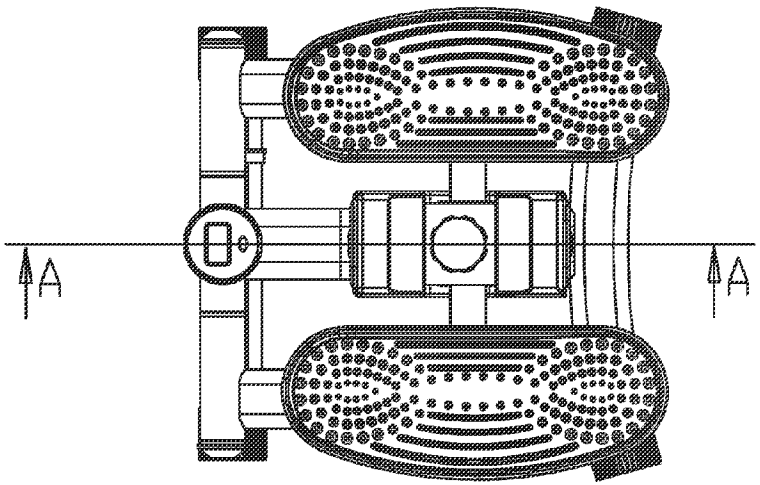
FIGS. 10C and 10D show two left side sectional views of the exercise machine.
Figure 10D:
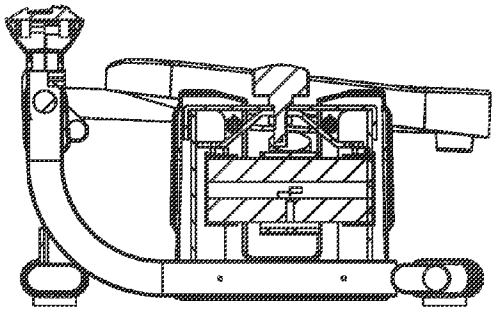
Figure 10C:
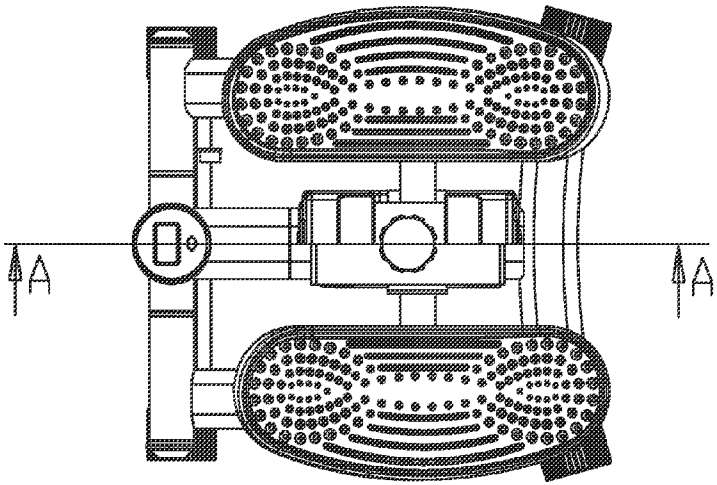
Figure 10C:
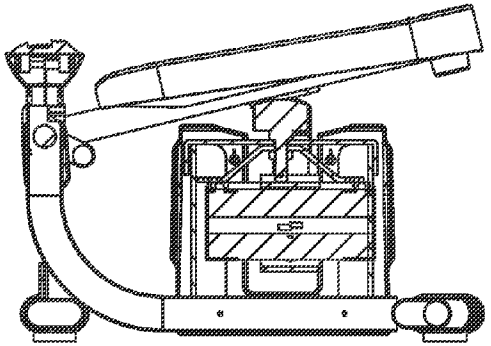

FIGS. 10A and 10B show two sectional views of an exercise machine according to another embodiment of the invention. FIGS. 10C and 10D show two left side sectional views of the exercise machine. The exercise machine in FIGS. 10A-10D corresponds to the exploded view of FIG. 5 and the perspective view of FIG. 7, except that the handlebar 170 in FIG. 7 is not included in FIGS. 10A-10D.

In the foregoing specification, embodiments of the invention have been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An exercise machine, comprising:

a base frame adapted to be positioned on a support surface;

a pair of left and right pedal assemblies, each of which positioned over and rotatably supported by the base frame at a first end of the left and right pedal assemblies, the pedal assemblies having a pair of left and right pedals, and a pedal supporting assembly attached to the base frame and configured to pivot around an axis and support the left and right pedal assemblies at a second end of each of the left and right pedal assemblies, the pedal supporting assembly comprising a resistance generating component, wherein the resistance generating component includes an elastic component operable to generate resistance in response to movement of the left and right pedals and the pedal supporting assembly pivoting around the axis.

2. The exercise machine of claim 1, wherein the resistance generated by the pedal supporting assembly is proportional to a degree by which the pedal supporting assembly pivots away from a neutral position.

3. The exercise machine of claim 1, the axis being positioned in a longitudinal direction of the exercise machine and parallel to the support surface.

4. The exercise machine of claim 1, wherein the elastic component adapted to attach the pedal supporting assembly to the base frame, the elastic component to become deformed, when the pedal supporting assembly pivots away from a neutral position, to adapt to a position change and generate the resistance.

5. The exercise machine of claim 4, wherein the base frame further comprises a bottom body to attach the pedal supporting assembly to the base frame, the bottom body configured with a front end receptacle and a rear end receptacle both to receive and constrain the elastic component, wherein the front end and rear end receptacles of the bottom body are stationary when the left and right pedals are in motion.

6. The exercise machine of claim 5, wherein the pedal supporting assembly further comprises a pedal supporting component for supporting the left and right pedal assemblies, the pedal supporting component having a hollow cross-section to contain the elastic component.

7. The exercise machine of claim 6, wherein the bottom body includes a pair of sliding slots to hold the front end and rear end receptacles, the pedal supporting component, and the elastic component.

8. The exercise machine of claim 7, wherein the relative position of the receptacles, the pedal supporting component, and the elastic component with respect to the pair of sliding slots is adjustable and to adjust the resistance generated by the pedal supporting assembly.

9. The exercise machine of claim 8, wherein the resistance generated by the pedal supporting assembly is adjustable by fastening or loosening a knob to change the relative position of the front end and rear end receptacles, the pedal supporting component, and the elastic component to the base frame.

10. The exercise machine of claim 5, wherein the elastic component has a central portion pivoting with the pedal supporting assembly, and the elastic component has a first constrained portion constrained by a first receptacle, and a second constrained portion constrained by a second receptacle, the first and second constrained portions located at opposing ends of the elastic component, and the first and second constrained portions of the elastic component generate torsion to force the central portion to return to the neutral position whenever the pedal supporting assembly pivots away from the neutral position.

11. The exercise machine of claim 4, wherein the resistance to the left pedal is substantially the same with the resistance to the right pedal.

12. The exercise machine of claim 4, wherein the base frame comprises a level parallel to the support surface that supports both the left and right pedal assemblies.

13. The exercise machine of claim 4, wherein the base frame comprises a left supporting rod to support the left pedal assembly and a right supporting rod to support the right pedal assembly.

14. The exercise machine of claim 13, wherein the angle between the left and right supporting rods is less than 180 degrees.

15. The exercise machine of claim 4, further comprising a handlebar assembly attached to a front end of the base frame to allow a user to hold onto the handlebar while stepping on the left and right pedals.

16. The exercise machine of claim 4, wherein the pedals have raised elements that increase friction with a user's feet and a heightened boundary to prevent a user from slipping off the pedals.

17. The exercise machine of claim 4, further comprising a display unit to display user exercise information.

* * * * *